United States Patent [19]

Spencer

[11] Patent Number: 5,013,218

[45] Date of Patent: May 7, 1991

[54] SUBMERSIBLE PNEUMATIC PUMP FOR WATER TABLE

[75] Inventor: Larry K. Spencer, Dallas, Tex.

[73] Assignee: Sigma Enterprises, Inc., Dallas, Tex.

[21] Appl. No.: 256,691

[22] Filed: Oct. 11, 1988

[51] Int. Cl.[5] ..... F04B 23/00

[52] U.S. Cl. ..... 417/37; 166/265; 210/104; 417/40; 417/392

[58] Field of Search ..... 417/392, 53, 37, 40, 417/39, 41, 36, 38, 435, 571, 572; 166/265, 54, 53, 68, 105, 107; 210/104, 923, 170, 776, 747, 97

[56] References Cited

U.S. PATENT DOCUMENTS

| | | | |
|---|---|---|---|
| 714,097 | 11/1902 | Caille | 417/435 |
| 2,180,818 | 11/1939 | Fields et al. | 417/571 |
| 2,340,943 | 2/1944 | Downs | 417/392 |
| 2,522,711 | 9/1950 | Ginter | 417/435 |
| 2,692,704 | 10/1954 | Benz | 417/392 |
| 3,126,965 | 3/1964 | Lindsey . | |
| 3,396,797 | 8/1968 | Little et al. . | |
| 3,941,510 | 3/1976 | Morgan . | |
| 4,009,756 | 3/1977 | Zehren . | |
| 4,273,650 | 6/1981 | Solomon | 210/104 |
| 4,466,777 | 8/1984 | Kimberlin | 417/36 X |
| 4,469,1"0 | 9/1984 | Farmer, Jr. | 166/265 X |
| 4,565,246 | 1/1986 | Frazier et al. . | |
| 4,649,994 | 3/1987 | Chaudot . | |
| 4,746,423 | 5/1988 | Moyer | 166/265 X |
| 4,761,225 | 8/1988 | Breslin | 166/265 X |

OTHER PUBLICATIONS

Scientific Discertation "Three Low Cost Pumping Systems for Hydrocarbon Contaminated Ground Water" by Claude A. J. Schleyer, presented at the Proceedings of Petroleum Hydrocarbons and Organic Chemicals in Ground Water: Prevention, Detection and Restoration—A Conference and Exposition, Nov. 17-19, 1987, published by National Water Well Association, pp. 43-54.

Descriptive brochure—price list—Bennett Sample Pumps Robert Bennett Company.

*Primary Examiner*—Leonard E. Smith

*Attorney, Agent, or Firm*—Crutsinger & Booth

[57] ABSTRACT

In accordance with the invention, there is provided a method and apparatus for removing hydrocarbons or other lighter than water pollutants from a water table by drilling a well to a depth below the surface of an underground water table; positioning a vessel having a negative buoyancy in fluid in the well; positioning an inlet into the vessel at a location below the surface of hydrocarbons floating on the surface of the water table and above the interface between the upper surface of the water and the lower surface of the hydrocarbon material; establishing a low liquid level in the vessel; establishing a high liquid level in the vessel; positioning the inlet to a pump in the vessel below the low liquid level; energizing the pump to remove liquid from the vessel when fluid reaches the high liquid level and deenergizing the pump when the surface of the liquid reaches the low liquid level but above the pump inlet.

38 Claims, 5 Drawing Sheets

SUBMERSIBLE PNEUMATIC PUMP FOR WATER TABLE

BACKGROUND OF THE INVENTION

This invention relates generally to pollution cleanup and more particularly concerns a method and apparatus for remedial recovery of hydrocarbons accumulated atop the ground water table as a result of spills, storage tank leaks and dumping.

The method and apparatus disclosed herein employs an improved submersible pneumatic pump adapted to recover gasoline, hydrocarbons and other lighter than water pollutants from the top of a subterranean water table. Hydrocarbons such as gasoline and oil are frequently spilled, leaked or dumped into the soil. These hydrocarbons soak into the ground, ultimately collecting atop the ground water table. Layers of hydrocarbon, as thick as sixteen feet deep, have been found atop ground water tables at or adjacent to refinery sites, gas stations and hydrocarbon storage facilities.

The present invention employs a submersible pneumatic pump to skim hydrocarbons from the surface of a water table. Prior art attempts to recover floating hydrocarbons have been costly, inefficient and tend to recover excessive quantities of ground water. The method and apparatus of the present invention assures the recovery of hydrocarbon pollutant without the accompanying production of significant amounts of ground water.

Prior art attempts to efficiently remove contaminates from atop the ground water table have been frustrated by failure to take into account a variety of conceptual, methodological and geological factors.

First, the recovery of pollutants from atop the ground water table normally involves very shallow recovery wells. Very frequently, the upper portions of the hydrocarbon layer are only a short distance beneath the surface. The soft and frequently sandy characteristics of the surrounding geological formation are very different from the characteristics of hard rock geological formations surrounding deeper wells.

Second, water tends to move more quickly through these shallow formations than does the pollutant, whose movement through a formation is dependent upon relatively small hydrostatic forces.

Third, efficient remedial hydrocarbon recovery requires that the rate of recovery not exceed the rate of hydrocarbon movement through the geological formation.

Fourth, efficient remedial hydrocarbon recovery requires that the collection situs be within the narrow layer of hydrocarbon and above the water table.

In contrast to the conventional aims of enhanced recovery (both in terms of quantity and rate) associated with oil and water wells, pollution cleanups require slow controlled recovery in order to accommodate the characteristics particular to the product and geological formation involved.

Prior art hydrocarbon pollution cleanup systems have typically failed to accommodate the tendency of hydrocarbons to move through a formation more slowly than water. Consequently, these systems produce large quantities of ground water and frequently so saturate the geological formation surrounding the collection site with water as to impede the influx of hydrocarbon to the collection site. The method and apparatus of the present invention employs a submersible pump situated above the ground water table within the hydrocarbon layer; the action of the pump being directly regulated by the influx of hydrocarbon to the collection site.

SUMMARY OF THE INVENTION

In accordance with the invention, there is provided a method and apparatus for removing hydrocarbons or other lighter than water pollutants from a water table by drilling a well to a depth below the surface of an underground water table; positioning a vessel having a negative buoyancy in fluid in the well; positioning the vessel's inlet at a location below the top surface of hydrocarbons on the water table and with the inlet above the interface between the water and the hydrocarbon material; establishing a low liquid level in the vessel; establishing a high liquid level in the vessel; positioning the inlet to a pump in the vessel below the low liquid level; selectively energizing the pump to remove liquid from the vessel when fluid reaches the high liquid level and de-energizing the pump when the surface of the liquid reaches the low liquid level.

BRIEF DESCRIPTION OF THE DRAWINGS

The objects and advantages of the invention will become apparent upon reading the following detailed description and upon reference to the drawings, in which.

While the invention is described in connection with a preferred embodiment and procedure, it will be understood that the description is not intended to limit the invention to that embodiment or procedure. On the contrary, it is intended to cover all alternatives, modifications and equivalents as may be included within the spirit and scope of the invention as defined by the appended claims.

DETAILED DESCRIPTION OF THE INVENTION

Figure 1:
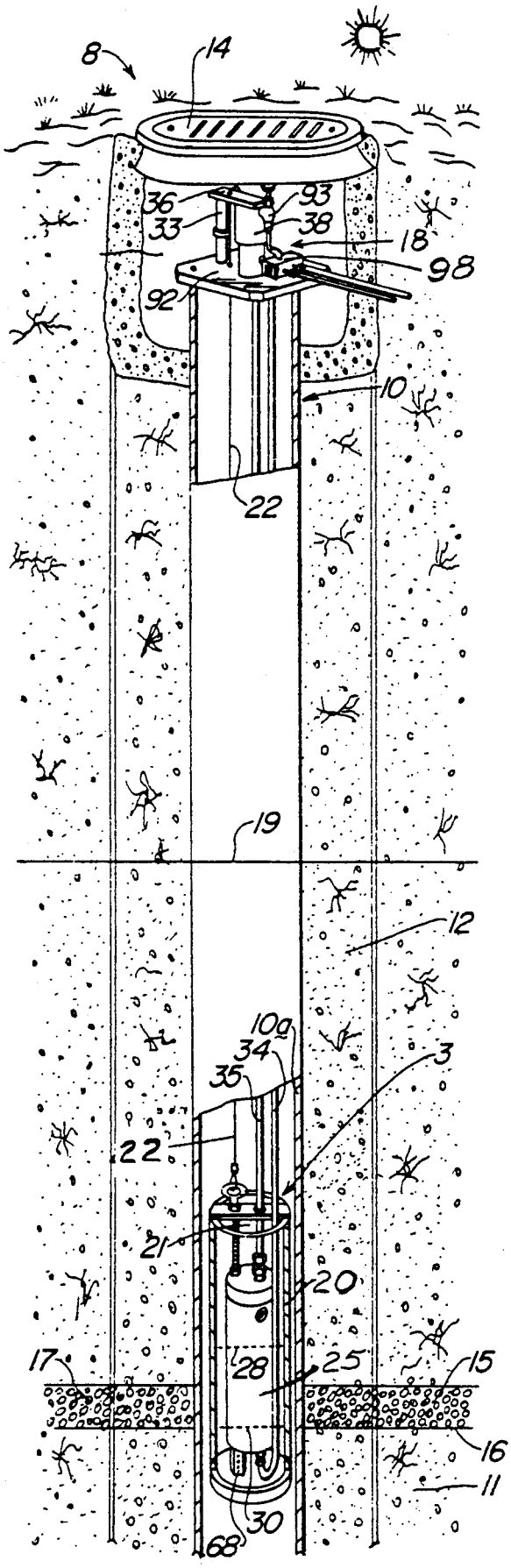
FIG. 1 is a diagrammatic illustration of a remedial hydrocarbon recovery well with the pump of the present invention installed herein.

Referring to FIG. 1 of the drawing, there is illustrated a recovery system generally designated by the numeral 8. Recovery system 8 generally has a downhole assembly 3 positioned underground in a perforated well casing 10*a* and a surface mounted control manifold 18. Downhole assembly 3 is shown suspended from a surface control manifold 18 by support cable 22.

By referring to FIG. 3 of the drawing, the surface control manifold 18 will be described. As will be pointed out herein, the manifold is operably connected to the downhole assembly 3. The manifold 18 has a manifold block 92, supporting an air supply tube 35, a production tube 34, a three-way valve 38, an adjustable spring 33, an actuating member 36, an orifice valve 93 and support cable 22. As shown in FIG. 1, manifold block 92 is secured at the surface end of well casing 10*a*. The manifold block 92 can be preferably positioned in an underground sump 13 for allowing hydrocarbon recovery operations to be unobtrusively conducted in even the most heavily trafficked locations, such as those that might be encountered near a truck terminal or automobile service station. Securing the surface control manifold underground beneath a manhole cover 14 additionally protects the system from tampering or accidental damage.

Figure 5:
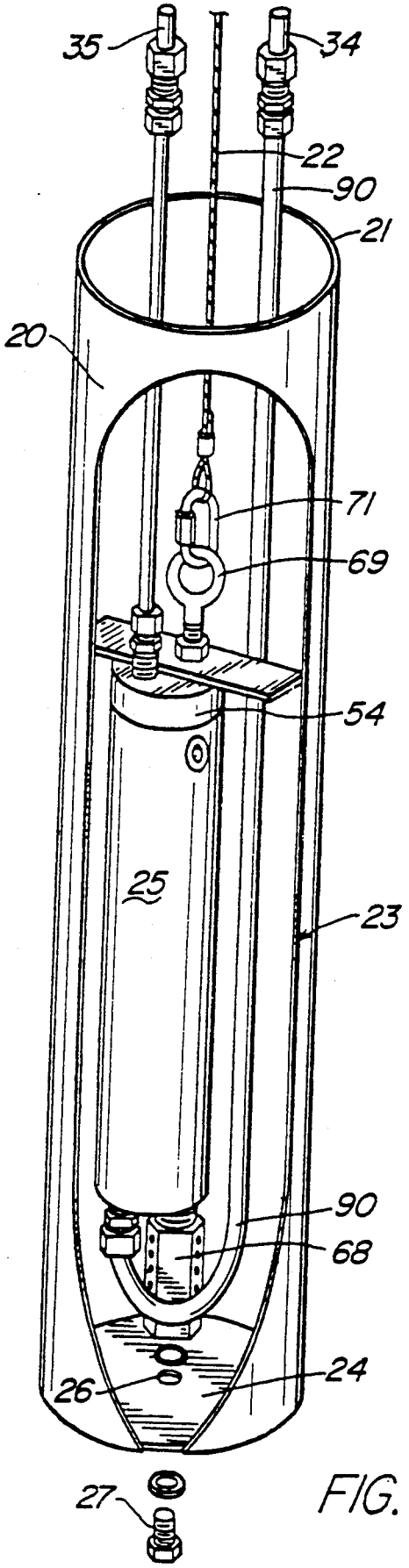
FIG. 5 is perspective view of the downhole assembly of the present invention.

As shown in FIG. 5, the downhole assembly 3 comprises vessel 20, a pump 25, a production tube 34, a pneumatic supply tube 35 and support cable 22. Vessel 20 is a hollow cylinder 23 having a closed bottom 24 and open at its upper end to provide a vessel inlet 21.

Referring to FIGS. 1 through 4 of the drawings, the numeral 25 designates the pump in a liquid receiving vessel 20 suspended from a support cable 22 in a perforated well casing 10*a*. Well 10 is drilled to a depth below the upper surface 16 of an underground water table 11. Cable 22 is suspended from an actuating member 36 pivotally connected to support fulcrum 37. Support fulcrum 37 is secured to three-way valve 38 adjacent trip plunger 41. An adjustable spring 33 resiliently urges actuating member 36 to rotate toward trip plunger 41 (in the direction of arrow "A"). Downhole assembly 3 having a negative buoyancy is suspended by support cable 22 in well casing 10*a* to position vessel inlet 21 at a location below the upper surface 19 of hydrocarbons 12 but above the interface 15 between the upper surface 16 of water 11 and the lower surface 17 of the hydrocarbon materials 12. Hydrocarbon 12 seeps through perforated well casing 10*a* and flows through vessel inlet 21, collecting in cylinder 23 adjacent bottom 24 of vessel 20. Proper positioning of the vessel inlet 21 skims hydrocarbons 12 into vessel 20 for recovery by pump 25 without removing water 11 from well 10.

Adjustable spring 33 is set at a predetermined tension such that when hydrocarbon 12 accumulates in vessel 20 in a sufficient volume to reach high liquid level 28, the cumulative weight of vessel 20, pump 25 and the accumulated hydrocarbon transferred to actuating member 36 via support cable 22 overcomes adjustable spring 33 and rotates actuating member 36 in the reverse direction of arrow "A" out of engagement with trip plunger 41 on three-way valve 38. Disengagement of trip plunger 41 allows actuation of the three-way valve 38 to activate submersible pneumatic pump 25 as will be explained to remove the hydrocarbon. Preferably, the pump is energized when the buoyancy of the vessel changes in a range of about equal to or less than seven pounds.

When actuated, the pump 25 draws hydrocarbon 12 from the bottom of vessel 20 through a strainer 68 and delivers collected fluid via production tube 34 to an above ground storage tank (not shown). When the volume of accumulated hydrocarbon 12 falls below low liquid level 30 in vessel 20, adjustable spring 33 overcomes the cumulative weight of vessel 20, pump 25 and the small amount of hydrocarbon 12 accumulated below the low liquid level 30 of vessel 20 and rotates the actuating member 36 in the direction of arrow "A" to reengage trip plunger 41 on three-way valve 38, de-energizing pump 25.

From the foregoing, it should be readily apparent that the intervals at which pump 25 is energized and de-energized is directly determined by the rate at which hydrocarbon 12 flows into vessel 20. By positioning the vessel inlet 21 at a set distance above the upper surface 16 of the water table 11, only hydrocarbon 12 floating on top of the water table 11 will flow into vessel 20 and be recovered from well 10.

Figure 4:
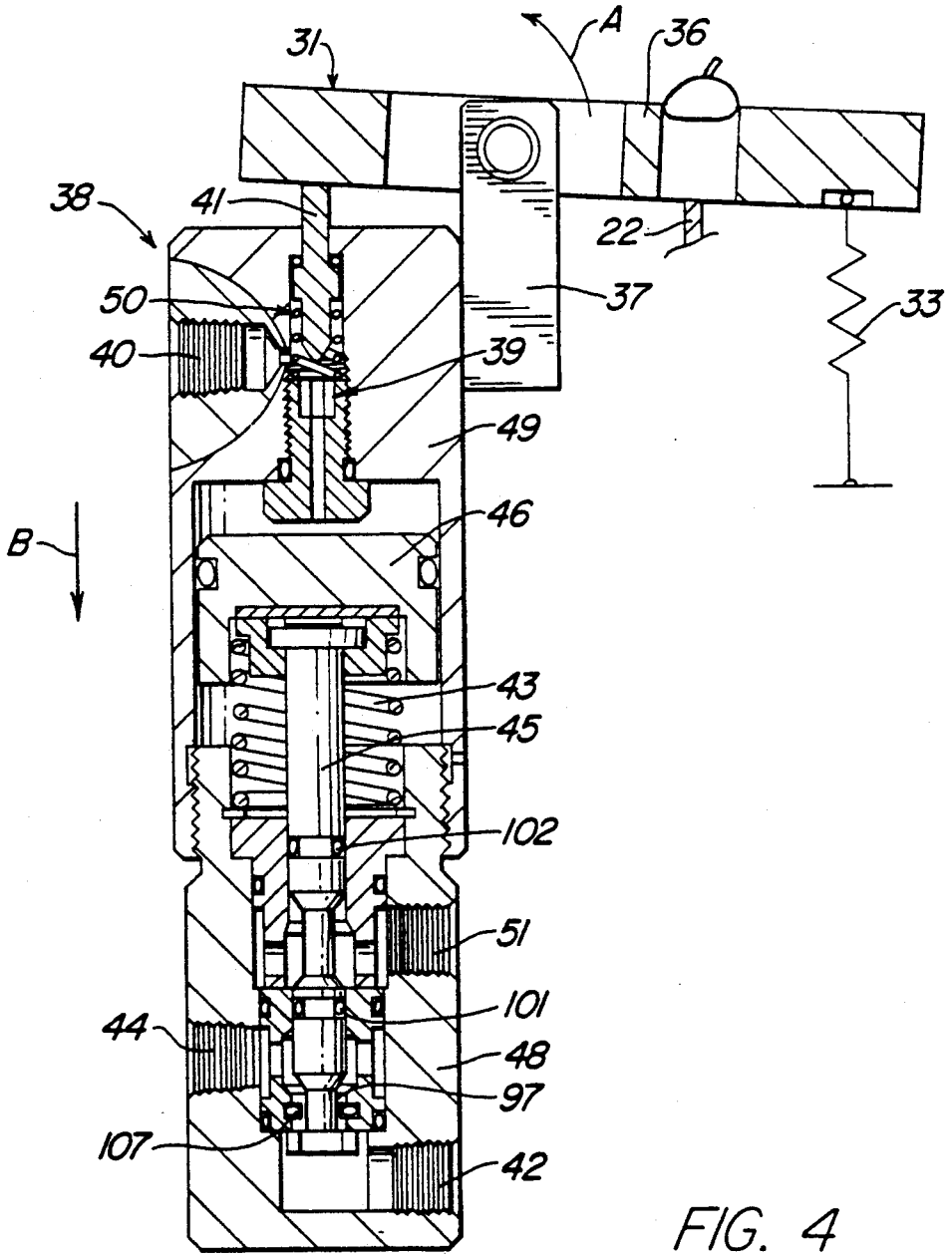
FIG. 4 is a front sectional view of the pump actuator of the present invention.

Referring to FIG. 4 of the drawing, there is illustrated the three-way valve 38 employed to actuate the submersible pneumatic pump 25. Three-way valve 38 comprises a conventional pneumatically activated three-way valve improved to add a counter balance trip assembly 31. According to the illustrated embodiment, counter balance trip assembly 31 is deployed in combination with an 18PC27 normally open three-way valve, commercially available from Sigma Enterprises, Inc., in Carrollton, Tex. It will be appreciated that a variety of conventional three-way valves may be employed. Preferably, a three way valve with a "deadband" or "no-flow" position between the open position and the closed position is used.

Normally open three-way valve 38 generally comprises a body 48, pilot housing 49, piston 46, plunger 45 and spring 43. Three-way valve 38 is provided with a pilot port 40, a pump port 44, a supply port 42 and exhaust port 51. Three-way valve 38 has been modified to provide a counter-balance trip assembly 31 comprising actuating member 36, support fulcrum 37, support cable 22, adjustable spring 33, trip plunger 41, trip seat 39 and trip spring 50.

The three-way valve 38 shown in FIG. 4 of the drawing is illustrated in the open position it would assume absent any pressurized air supply to port 40. In the open position, three-way valve 38 allows communication between pump port 44 and supply port 42 via passageway 97. Exhaust port 51 is blocked by seals 101 and 102. Air pressure admitted to three-way valve 38 via pilot port 40 shifts valve 38 to the closed position, acting upon piston 46 to shift plunger 45 downward in the direction of arrow "B." The downward travel of plunger 45 disengages seal 101 to open communication between pump port 44 and exhaust port 51. Simultaneously, seal 107 is engaged, sealing off passageway 97 and thereby blocking communication between pump port 44 and supply port 42. In the absence of air pressure to piston 46, spring 43 resiliently urges piston 46 and plunger 45 attached thereto upward (in the reverse direction of arrow "B") toward the normal open position.

Figure 2:
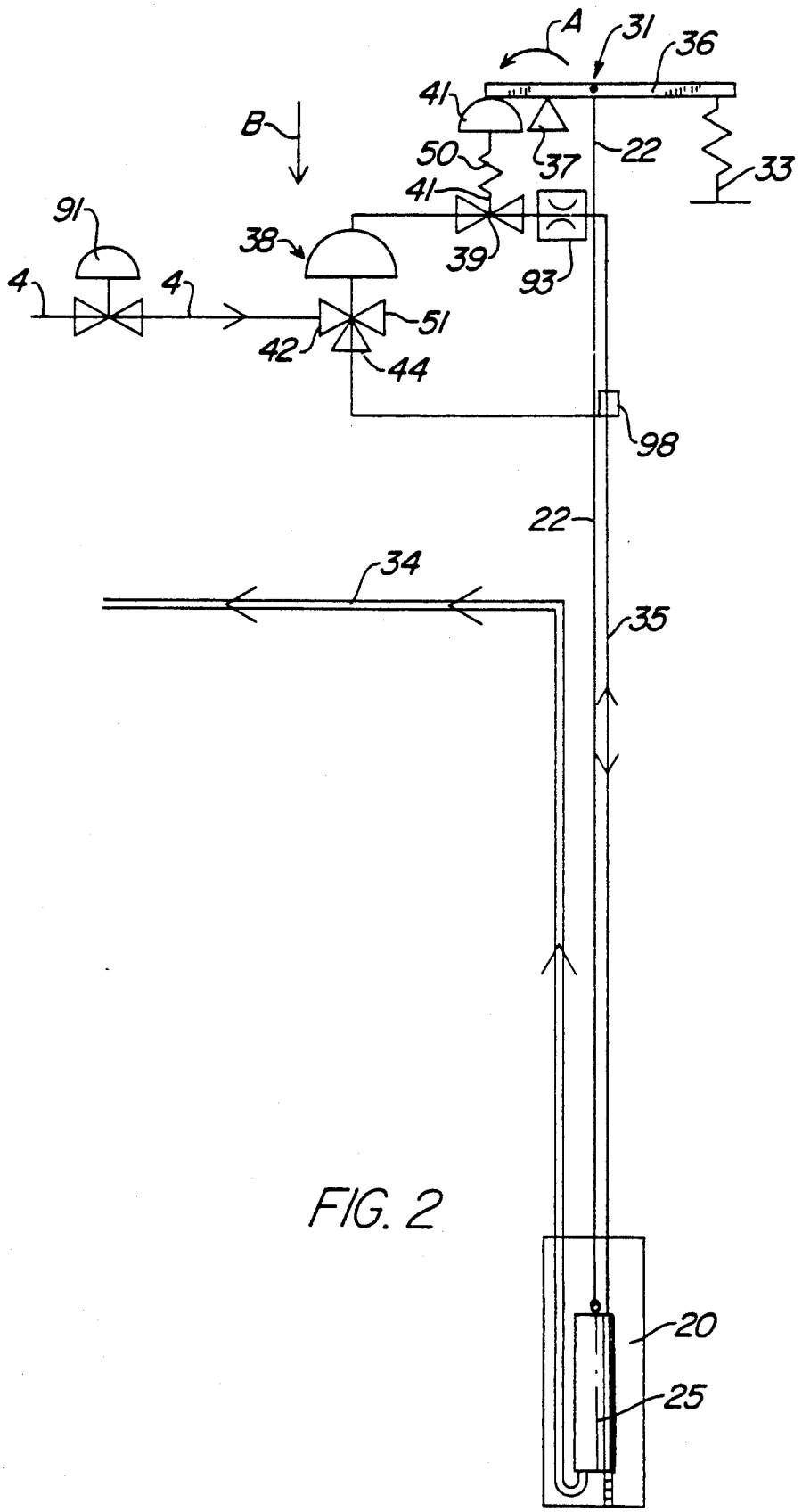
FIG. 2 is a diagrammatic representation of the control manifold of the present invention.
Figure 3:
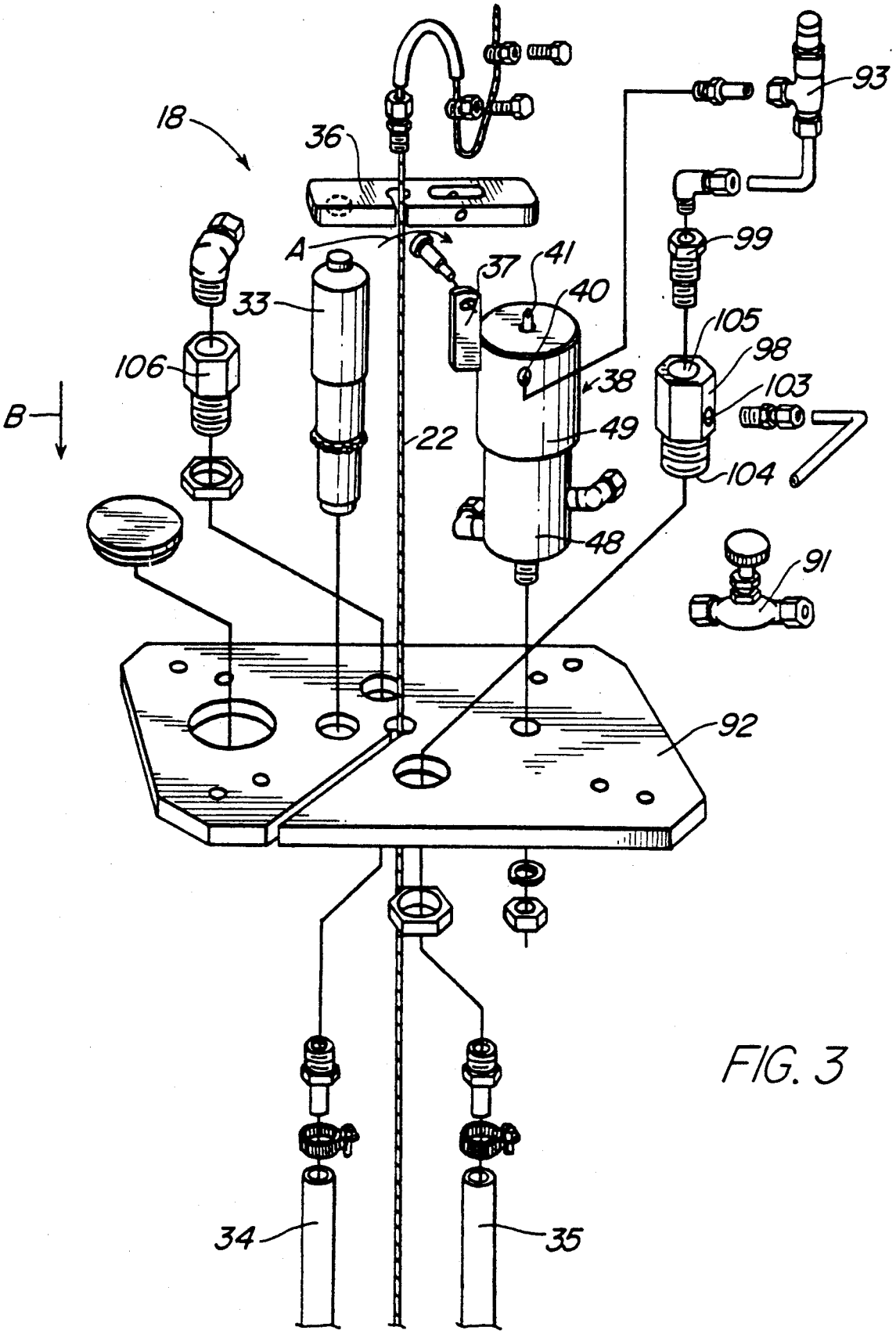
FIG. 3 is an exploded perspective view of the control manifold shown in FIG. 2.

Referring to FIGS. 2, 3 and 4 of the drawing, trip plunger 41 is resiliently urged in the direction of arrow "A" against trip seat 39 by actuating member 36.

Three-way valve 38 shifts to the closed position when air pressure from pilot port 40 is allowed passage beyond trip seat 39 and through pilot housing 49 to act upon piston 46. Air pressure acting on piston 46 moves plunger 45 downward to seal supply port 42 and opening communication between exhaust port 51 and pump port 44.

Referring to FIGS. 2 and 4 of the drawing, pressurized air constantly supplied through air supply line 4 is admitted to supply port 42 via air supply shut-off valve 91. Pump port 44 is connected by tubing and fittings to port 103 of manifold 98. Manifold 98 is provided with ports 103, 104 and 105, each of which communicate with the other two ports. Port 104 of manifold 98 is connected through manifold block 92 to air supply tube 35. Port 105 of manifold 98 is connected to one end of adjustable orifice valve 93; the opposite end of adjustable orifice valve 93 being connected to pilot port 40 of three-way valve 38.

Three-way valve 38 is shifted from its normally open position to its closed position when hydrocarbon 12 accumulated in vessel 20 reaches high liquid level 28. At that point, the cumulative weight of vessel 20, pump 25 and accumulated hydrocarbon 12 exerts sufficient downward force upon support cable 22 to rotate to actuating member 36 (in the reverse direction of arrow "A") and overcome the opposing upward force of adjustable spring 33. The force transferred to actuating member 36 disengages the opposite end of actuating member 36 from trip plunger 41 on three-way valve 38. When actuating member 36 disengages trip plunger 41, trip spring 50 resiliently urges trip plunger 41 upwardly in the reverse direction of arrow "B" and allows air pressure from pilot port 40 to act upon piston 46 forcing piston 46 to move in the direction of arrow "B."

When sufficient hydrocarbon 12 has been delivered to storage tank via pump 25 to reduce the volume of accumulated hydrocarbon 12 in vessel 20 to a level below low liquid level 30, the cumulative weight of downhole assembly 3 is sufficiently reduced to allow the upward force of adjustable spring 33 to overcome the downward forces imparted by support cable 22, pivoting the end of actuating member 36 in the direction of arrow "A" to contact trip plunger 41. The downward force supplied by actuating member 36 to trip plunger 41 is sufficient to overcome the upward force of trip spring 50 and forces trip plunger to engage trip seat 39, thereby blocking air pressure from pilot port 40.

Figure 6:
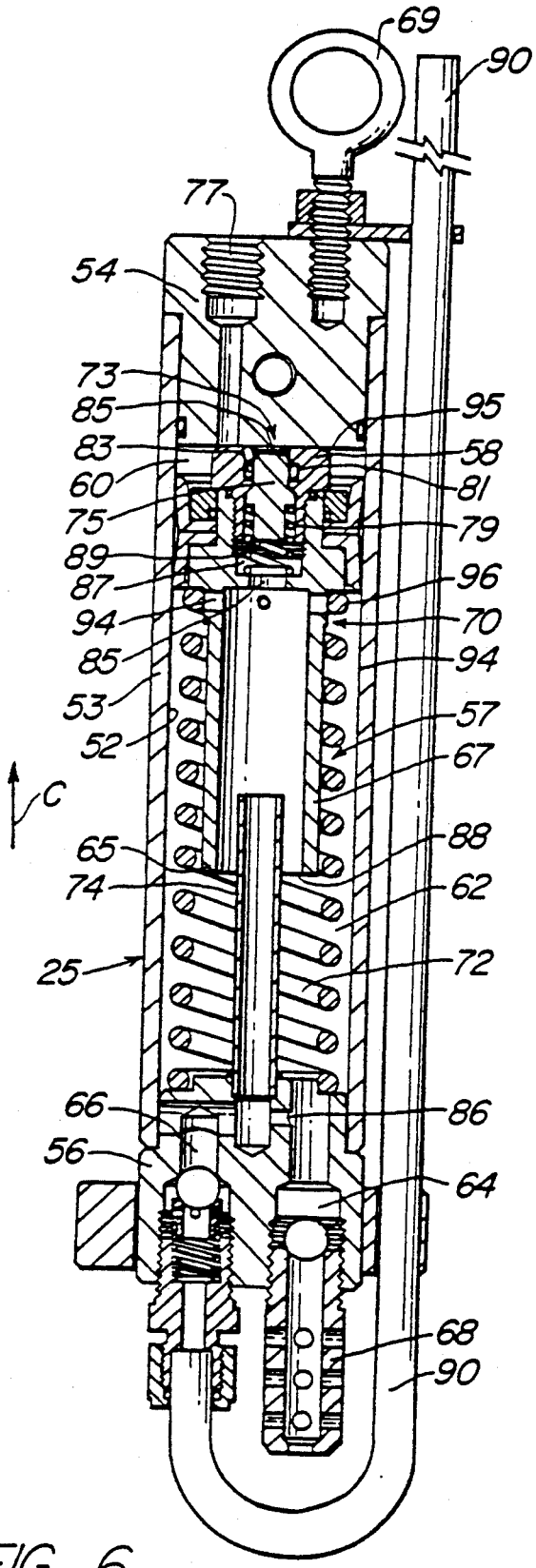
FIG. 6 is a sectional view of the submersible pump of the present invention.

Turning to FIGS. 5 and 6, submersible pneumatic pump 25 has a cylinder 53, an upper closure member 54, a lower closure member 56, a piston 58, a spring guide sleeve 70, an inward opening check valve 64, an outward opening check valve 66, a strainer 68, an eyebolt 69 and a curved production tube 90. Pump 25 is preferably secured to vessel 20 by bolt 27 which extends through hole 26 in bottom 24 of vessel 20 and threadedly engages strainer 68 of pump 25. Eyebolt 69 threadedly engages upper closure member 54 and is secured by locking link 71 to one end of support cable 22. Thus, the entire downhole assembly 3 may be raised or lowered to varying depths within well 10 by adjusting the length of support cable 22.

Hollow cylinder 53 has an internal chamber 57. Piston 58 is slidably positioned within chamber 57 in sealing engagement with wall 52 intermediate upper closure member 54 and lower closure member 56. Piston 58 effectively divides chamber 57 into an upper actuator section 60 and a lower pumping section 62. Sleeve 70 comprising a hollow cylinder secured at 96 to piston 58. Spring guide sleeve 70 has an opening 88 adjacent its bottom end 65 and an aperture 94 extending through sidewall 67. Spring guide sleeve 70 is positioned to contact lower closure member 56, limiting the downward stroke of piston 58. Aperture 94 is positioned adjacent bottom 96 of piston 58 for allowing air trapped within pumping section 62 access to priming tube 74 as will be hereinafter discussed. A supply port 77 is provided in upper closure member 54. Port 77 communicates with actuator section 60 of chamber 57 for delivery of air pressure via air supply tube 35 to the top of piston 58.

An inward opening check valve 64 is provided in lower closure member 56. Valve 64 permits the flow of fluid into pumping section 62 of chamber 57 from vessel 20 while blocking flow of fluid outwardly therethrough from pumping section 62 of chamber 57. Inwardly opening check valve 64 is provided with a strainer 68 for filtering fluid flowing through inwardly opening check valve 64 into pumping section 62 of chamber 57.

An outwardly opening check valve 66 is provided in lower closure member 56 in spaced apart relation to inwardly opening check valve 64. Outwardly opening check valve 66 communicates with the pumping section 62 of chamber 57 for permitting flow of fluid from pumping section 62 of chamber 57 while blocking flow of fluid inwardly therethrough into pumping section 62 of chamber 57. Outwardly opening check valve 66 is connected to one end of curved production tube 90, the opposite end of curved production tube 90 being attached to production tube 34.

Piston 58 is resiliently urged upward in the direction of arrow "C" by spring 72. One end of spring 72 being positioned adjacent the bottom of piston 58, the opposite end thereof being positioned adjacent lower closure member 56. Spring 72 resiliently urges piston 58 to a position wherein the volume of the actuating section 60 of chamber 57 is significantly smaller than the volume of the pumping section 62 of chamber 57.

Piston 58 is provided with a pressure relief valve 73 comprising a poppet 75, poppet spring 79 and O-ring 81. Poppet 75 is positioned within a central port 85 extending between top 95 of piston 58 and bottom 96 of piston 58. Central port 85 is provided with an enlarged central cavity 87, intermediate top 95 of piston 58 and bottom 96 of piston 58. O-ring 81 is secured within an annular groove 83 inside central port 85 and adjacent top 95 of piston 58. Poppet spring 79 is positioned within central cavity 87 adjacent the bottom 89 of poppet 75 for resiliently urging poppet 75 to engage O-ring 81 for preventing air passage through central port 85. In the event that water or debris accumulates adjacent top of piston 95, pump 25 may be over pressured for expelling water or debris from the actuating system. Sufficient pressure applied to the top of poppet 75 forces poppet 75 to disengage O-ring 81, allowing water and debris to be expelled from the actuator section 60 of pump 25 through central port 85 and into pumping section 62. Any expelled water and debris can then be pumped to the surface.

As best shown in FIG. 6, pump 25 is provided with a hollow priming tube 74, secured at one end to outwardly opening check valve 66 and extending upwardly inside spring guide sleeve 70 to a point adjacent the bottom stroke position of piston 58. By so positioning priming tube 74, any air accumulating within pumping section 62 may be preferentially expelled from pumping section 62 through outwardly opening check valve 66 and into production tube 34.

According to the illustrated embodiment, pump 25 is positioned such that fluid is forced downwardly by piston 58 through outwardly opening check valve 66 and into a curved production tube 90 for delivery to the surface via production line 34. Such positioning assures that silt, sediment and sand frequently found in well casings 10*a* will settle below piston 58 rather than adjacent the top 95 of piston 58, thereby reducing the possibility for wear and galling of piston 58. It will of course be appreciated that this inverted positioning of pump 25 accommodates the slow and intermittent pumping required for floating hydrocarbon recovery and the associated tendency for sediment to gravitate downwardly rather than being carried to the surface as would be the case with a high volume/high rate pumping system.

Curved production tube 90 is attached to outwardly opening check valve 66 and is provided with a 180 degree bend adjacent lower closure member 56 for redirecting fluid upwardly. The opposite end of curved production tube 90 is attached to production tube 34.

Pump 25 is further provided with a venturi passage 86 formed within lower closure member 56, venturi passage 86 having opposite ends communicating with inwardly opening check valve 64 and outwardly opening check valve 66 respectively. Venturi passage 86 is adapted to draw sediment, silt or sand which may accumulate within pumping section 62 adjacent lower closure member 56; sand, sediment or silt being drawn through outwardly opening check valve 66 and directed through curved production tube 90 for delivery to the surface via production tube 34.

Referring to FIGS. 2, 3, 4 and 6, when three-way valve 38 is in the open position, air pressure supplied to supply port 42 is relayed to pump port 44 through passageway 97. Pressurized air is communicated by pump port 44 to manifold 98 and air supply tube 35 which connects to supply port 77 of pump 25. Air pressure admitted to actuating section 60 through supply port 77 exerts force across the top 95 of piston 58, to overcome the upward resistance of spring 72 and force piston 58 to move downwardly through chamber 57, increasing the volume of actuating section 60 while decreasing the volume of pumping section 62. The downward stroke of piston 58 forces fluid from pumping section 62 through outwardly opening check valve 66 into curved production tube 90 for delivery to production tube 34 and ultimately to storage tank 6.

Orifice valve 93 is connected at opposite ends to manifold 98 and pilot port 40 of three-way valve 38. Orifice valve 93 is adjusted to gradually admit air pressure to pilot port 40 and provide a timing mechanism for regulating the intervals at which three-way valve 38 is actuated. When sufficient air pressure is admitted to pilot port 40 and allowed access to piston 46 via trip seat 39, plunger 45 will be forced downward sealing supply port 42 and opening communication between pump port 44 and exhaust port 51. In this the closed position, air pressure is bled from the actuating section of pump 25 and incoming supply pressure from air supply line 4 is blocked. As pressure is relieved from actuating section 60 of pump 25, spring 72 forces piston 58 upwardly, reducing the volume of actuating section 60 relative to the volume of pumping section 62. The volumetric expansion of pumping section 62 caused by the upward travel of piston 58 results in vacuous force within pumping section 62, said force drawing hydrocarbon 12 into pumping section 62 through strainer 68 and inwardly opening check valve 64.

Because orifice valve 93 is supplied with air pressure via pump port 40, the block and bleed closed position of the three-way valve 38 relieves pressure from the top of piston 46. Thus, when trip plunger 41 is disengaged from trip seat 39, three-way valve 38 will "shuttle" between the open and closed positions, thereby cycling pump 25. The rate at which three-way valve will open or close is dependent upon the adjustment of the orifice valve 93 which serves as a timing device.

Figure 7:
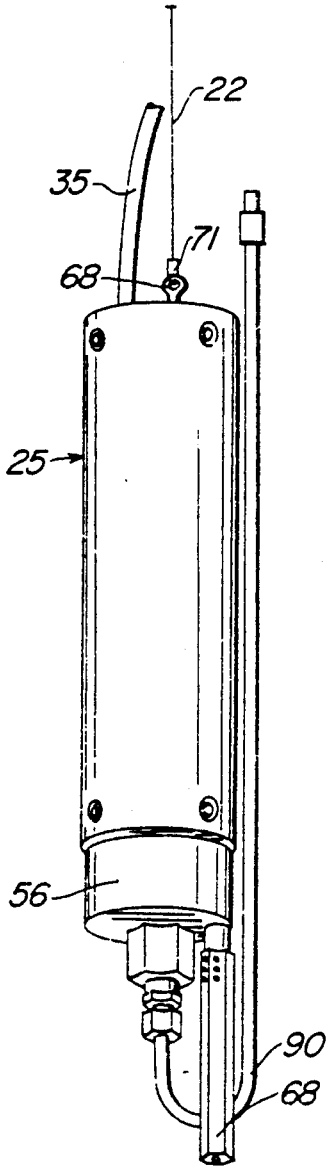
FIG. 7 is a perspective view of the submersible pump of the present invention.

It will of course be appreciated that pump 25 may be used independent of vessel 20 as shown in FIG. 7 of the drawing, for recovery of fluids when subterranean separation of pollutants from water is not required, as in the case of ordinary sump pump or water well operations.

What is claimed is:

1. Apparatus for removing hydrocarbons from a water table comprising: a vessel having a negative buoyancy, said vessel having an inlet; cable means positioning said inlet at a location below the surface of hydrocarbons floating on the surface of the water and above the interface between the upper surface of the water and the lower surface of the hydrocarbon material; pump means having an inlet communicating with said vessel; control means; and support means secured to said cable for suspending said vessel such that the inlet is positioned above the interface between the water and the hydrocarbons such that hydrocarbons floating on the surface of the water flow into the vessel; and actuating means associated with said support means adapted to energize said pump means when tensions in said cable reaches a predetermined magnitude when said vessel contains more than a predetermined volume of hydrocarbons.

2. Apparatus to remove a first liquid floating on the surface of a second liquid in a well comprising: a vessel having negative buoyancy and having a low liquid level, a high liquid level and an inlet; tension carrying means positioning said inlet into the vessel at a location below the surface of the first liquid floating on the surface of the second liquid and above the interface between the upper surface of the second liquid and the lower surface of the first liquid; pump means having an inlet; means positioning the inlet to said pump means in the vessel below the low liquid level; means actuated by said tension carrying means for energizing said pump means to remove liquid from said vessel when liquid reaches the high liquid level; and means actuated by said tension carrying means for de-energizing said pump means when the surface of the liquid reaches the low liquid level.

3. A pump to remove a first liquid floating on a second liquid comprising: a vessel having an inlet; a cylinder having an inner tube wall; upper and lower closures on said cylinder forming an interior chamber defined by said inner wall in the cylinder and bounded on opposite ends by said upper and lower closure members, said chamber having an inlet opening; means mounting said cylinder such that said inlet opening is in fluid communication with said vessel; a piston in said chamber dividing said chamber into an actuator section and a pumping section; a cylindrical spring guide sleeve having an aperture formed in the wall thereof secured to said piston to limit movement of said piston to control the minimum volume of said pumping section of the chamber; an inwardly opening check valve communicating with said pumping section of the chamber permitting flow of fluid from said vessel through said inlet opening into the chamber while blocking flow of fluid from the chamber into the vessel; an outwardly opening check valve communicating with the pumping section of the chamber permitting flow of fluid from the pumping section of the chamber and blocking flow of fluid therethrough into the pumping section of the chamber; means to reciprocate said piston through the chamber; means positioning the inlet of said vessel adjacent an interface between the first and second fluids to skim the first liquid into the vessel; and means to actuate said means to reciprocate said piston through the chamber in response to the volume of first liquid contained in said vessel.

4. A method of separating hydrocarbons from water in a well and removing the separated hydrocarbons from the well comprising the steps of suspending a vessel from a support cable; adjusting the length of the support cable for positioning an inlet into the vessel below the surface of hydrocarbons floating on the surface of water but above the surface of the water; determining the tension in the support cable when the vessel is filled with a predetermined volume of hydrocarbons; energizing a control device when the tension in the support cable reaches the predetermined level to remove a portion of the volume of liquid from the vessel such that the rate at which hydrocarbons are pumped from the well is controlled by the rate of influx of hydrocarbons into the well.

5. A pump comprising a cylinder having an inner tube wall; upper and lower closures on said cylinder forming an interior chamber defined by said inner wall in the cylinder are bounded on opposite ends by said upper and lower closure members; a piston in said chamber dividing said chamber into an actuator section and a pumping section; a cylindrical spring guide sleeve in said pumping section of the chamber to limit movement of said piston to control the minimum volume of said pumping section of the chamber, said sleeve being secured to said piston; an inwardly opening check valve communicating with said pumping section of the chamber permitting flow of fluid into the chamber while blocking flow of fluid therethrough from the chamber; an outwardly opening check valve communicating with the pumping section of the chamber permitting flow of fluid from the pumping section of the chamber and blocking flow of fluid therethrough into the pumping section of the chamber; means resiliently urging said piston to a position wherein the volume of the actuating section of the chamber is smaller than the volume of the pumping section of the chamber; means to deliver pressurized fluid into said actuating section of the chamber for urging the piston through the chamber to decrease the volume of the pumping section of the chamber relative to the actuating section of the chamber; and means to exhaust pressurized fluid from said actuating section of the chamber.

6. A pump comprising a cylinder having an inner tube wall; upper and lower closures on said cylinder forming an interior chamber defined by said inner wall in the cylinder and bounded on opposite ends by said upper and lower closure members; a piston in said chamber dividing said chamber into an actuator section and a pumping section, said piston having a port extending therethrough having a first end communicating with said pumping section of said chamber and a second end communicating with said actuating section of said chamber; a valve seat intermediate opposite ends of said port; valve means in said port; and resilient means in said port urging said valve means into engagement with said valve seat for blocking flow of fluid through said port; an inwardly opening check valve communicating with said pumping section of the chamber permitting flow of fluid into the chamber while blocking flow of fluid therethrough from the chamber; an outwardly opening check valve communicating with the pumping section of the chamber permitting flow of fluid from the pumping section of the chamber and blocking flow of fluid therethrough into the pumping section of the chamber; means resiliently urging said piston to a position wherein the volume of the actuating section of the chamber is smaller than the volume of the pumping section of the chamber; means to deliver pressurized fluid into said actuating section of the chamber for urging the piston through the chamber to decrease the volume of the pumping section of the chamber relative to the actuating section of the chamber; and means to exhaust pressurized fluid from said actuating section of the chamber.

7. A pump to remove a first liquid floating on a second liquid comprising: a vessel having an inlet; a cylinder having an inner tube wall; upper and lower closures on said cylinder forming an interior chamber defined by said inner wall in the cylinder and bounded on opposite ends by said upper and lower closure members, said chamber having an inlet opening; means mounting said cylinder such that said inlet opening is in fluid communication with said vessel; a piston in said chamber dividing said chamber into an actuator section and a pumping section, said piston having a port extending therethrough having a first end communicating with said pumping section of said chamber and a second end communicating with said actuating section of said chamber; a valve seat intermediate opposite ends of said port; valve means in said port; resilient means in said port urging said valve means into engagement with said valve seat for blocking flow of fluid through said port, said resilient means urging said valve toward a normally closed position blocking the flow of pressurized fluid from the actuating section of the chamber into said pumping section of the chamber until pressure in said actuating section exceeds a predetermined limit whereupon said valve moves away from said valve seat permitting flow of pressurized fluid from said actuating section into said pumping section; an inwardly opening check valve communicating with said pumping section of the chamber permitting flow of fluid from said vessel through said inlet opening into the chamber while blocking flow of fluid from the chamber into the vessel; an outwardly opening check valve communicating with the pumping section of the chamber permitting flow of fluid from the pumping section of the chamber and blocking flow of fluid therethrough into the pumping section of the chamber; means to reciprocate said piston through the chamber; means positioning the inlet of said vessel adjacent an interface between the first and second fluids to skim the first liquid into the vessel; and means to actuate said means to reciprocate said piston through the chamber in response to the volume of first liquid contained in said vessel.

8. Apparatus for removing hydrocarbons from a water table comprising: a vessel having a negative buoyancy, said vessel having an inlet; support means positioning said inlet at a location below the surface of hydrocarbons floating on the surface of the water and above the interface between the upper surface of the water and the lower surface of the hydrocarbon material; a cylinder having an inner tube wall; upper and lower closures on said cylinder forming an interior chamber defined by said inner wall in the cylinder and bounded on opposite ends by said upper and lower closure members; a piston in said chamber dividing said chamber into an actuator section and a pumping section; an inwardly opening check valve communicating with said vessel and said pumping section of the chamber permitting flow of fluid into the chamber while blocking flow of fluid therethrough from the chamber; an outwardly opening check valve communicating with the pumping section of the chamber permitting flow of fluid from the pumping section of the chamber and blocking flow of fluid therethrough into the pumping section of the chamber; a priming tube in said pumping section of said chamber, said priming tube having a central passage formed therethrough, one end of which communicates with said outwardly opening check valve and the other end of which is positioned intermediate opposite ends of said pumping section such that movement of said piston to reduce the volume of said pumping section causes fluid in said pumping section to be delivered into said tube at a location spaced from said lower closure member; means resiliently urging said piston to a position wherein the volume of the actuating section of the chamber is smaller than the volume of the pumping section of the chamber; means to deliver pressurized fluid into said actuating section of the chamber for urging the piston through the chamber to decrease the volume of the pumping section of the chamber relative to the actuating section of the chamber; means to exhaust pressurized fluid from said actuating section of the chamber; support means suspending said vessel such that the inlet is positioned above the interface between the water and the hydrocarbons such that hydrocarbons floating on the surface of the water flow into the vessel; and actuating means adapted to energize said means to deliver pressurized fluid when said vessel contains more than a predetermined volume of hydrocarbons.

9. Apparatus to remove a first liquid floating on the surface of a second liquid in a well comprising: a vessel having negative buoyancy and having a low liquid level, a high liquid level and an inlet; a cylinder in said vessel, said cylinder having an inner tube wall; upper and lower closures on said cylinder forming an interior chamber defined by said inner wall in the cylinder and bounded on opposite ends by said upper and lower closure members; a piston in said chamber dividing said chamber into an actuator section and a pumping section; an inwardly opening check valve communicating with said pumping section of the chamber permitting flow of fluid into the chamber while blocking flow of fluid therethrough from the chamber; an outwardly opening check valve communicating with the pumping section of the chamber permitting flow of fluid from the pumping section of the chamber and blocking flow of fluid therethrough into the pumping section of the chamber; a priming tube in said pumping section of said chamber, said priming tube having a central passage formed therethrough, one end of which communicates with said outwardly opening check valve and the other end of which is positioned intermediate opposite ends of said pumping section such that movement of said piston to reduce the volume of said pumping section causes fluid in said pumping section to be delivered into said tube at a location spaced from said lower closure member; means resiliently urging said piston to a position wherein the volume of the actuating section of the chamber is smaller than the volume of the pumping section of the chamber; means to deliver pressurized fluid into said actuating section of the chamber for urging the piston through the chamber to decrease the volume of the pumping section of the chamber relative to the actuating section of the chamber; means to exhaust pressurized fluid from said actuating section of the chamber; support means positioning said inlet into the vessel at a location below the surface of the first liquid floating on the surface of the second liquid and above the interface between the upper surface of the second liquid and the lower surface of the first liquid; pump means having an inlet; means positioning the inlet to said pump means in the vessel below the low liquid level; means energizing said means to deliver pressurized fluid into said actuating section to remove liquid from said vessel when liquid reaches the high liquid level; and means de-energizing said means to deliver pressurized fluid when the surface of the liquid reaches the low liquid level.

10. Apparatus to remove a first liquid floating on the surface of a second liquid in a well comprising: a vessel having negative buoyancy and having a low liquid level, a high liquid level and an inlet; support means positioning said inlet into the vessel at a location below the surface of the first liquid floating on the surface of the second liquid and above the interface between the upper surface of the second liquid and the lower surface of the first liquid; pump means having an inlet; means positioning the inlet to said pump means in the vessel below the low liquid level; means energizing said pump means to remove liquid from said vessel when liquid reaches the high liquid level; and means de-energizing said pump means when the surface of the liquid reaches the low liquid level, said pump means comprising a cylinder having an inner tube wall; upper and lower closures on said cylinder forming an interior chamber defined by said inner wall in the cylinder and bounded on opposite ends by said upper and lower closure members; a piston in said chamber dividing said chamber into an actuator section and a pumping section; an inwardly opening check valve communicating with said pumping section of the chamber permitting flow of fluid into the chamber while blocking flow of fluid therethrough from the chamber; an outwardly opening check valve communicating with the pumping section of the chamber permitting flow of fluid from the pumping section of the chamber and blocking flow of fluid therethrough into the pumping section of the chamber, said lower closure having a venturi passage formed therein having opposite ends communicating with said inwardly and outwardly opening check valves, said venturi passage being constructed and arranged to draw sediment from the lower portion of said pumping section; means resiliently urging said piston to a position wherein the volume of the actuating section of the chamber is smaller than the volume of the pumping section of chamber; means to deliver pressurized fluid into said actuating section of the chamber for urging the piston through the chamber to decrease the volume of the pumping section of the chamber relative to the actuating section of the chamber; and means to exhaust pressurized fluid from said actuating section of the chamber.

11. Apparatus for removing hydrocarbons from a water table comprising: a vessel having a negative buoyancy, said vessel having an inlet; support means positioning said inlet at a location below the surface of hydrocarbons floating on the surface of the water and above the interface between the upper surface of the water and the lower surface of the hydrocarbon material; pump means having an inlet communicating with said vessel; support means suspending said vessel such that the inlet is positioned above the interface between the water and the hydrocarbons such that hydrocarbons floating on the surface of the water flow into the vessel; and actuating means associated with said support means and adapted to energize said pump means when tension in said support means exceeds a predetermine value when said vessel contains more than a predetermined volume of hydrocarbons.

12. Apparatus for removing hydrocarbons from a water table according to claim 11, said vessel comprising an elongated tubular member having an inner wall;

closure means on said tubular member forming an interior compartment in said tubular member and bounded on one end by said closure member, the upper end of said tubular member forming a weir over which hydrocarbons flow into said interior compartment.

13. Apparatus for removing hydrocarbons from a water table according to claim 11, said pump means comprising pressure actuated pump means, and said actuating means comprising: control valve means; a source of pressurized fluid mounted to deliver pressurized fluid to said control valve means; and a supply line extending from said control valve means to said actuating section of the chamber.

14. A pump comprising a cylinder having an inner tube wall; upper and lower closures on said cylinder forming an interior chamber defined by said inner wall in the cylinder and bounded on opposite ends by said upper and lower closure members; a piston in said chamber dividing said chamber into an actuator section and a pumping section; an inwardly opening check valve communicating with said pumping section of the chamber permitting flow of fluid into the chamber while blocking flow of fluid therethrough from the chamber; an outwardly opening check valve communicating with the pumping section of the chamber permitting flow of fluid from the pumping section of the chamber and blocking flow of fluid therethrough into the pumping section of the chamber; a priming tube in said pumping section of said chamber, said priming tube having a central passage formed therethrough, one end of which communicates with said outwardly opening check valve and the other end of which is positioned intermediate opposite ends of said pumping section such that movement of said piston to reduce the volume of said pumping section causes fluid in said pumping section to be delivered into said tube at a location spaced from said lower closure member means resiliently urging said piston to a position wherein the volume of the actuating section of the chamber is smaller than the volume of the pumping section of the chamber; means to deliver pressurized fluid into said actuating section of the chamber for urging the piston through the chamber to decrease the volume of the pumping section of the chamber relative to the actuating section of the chamber; and means to exhaust pressurized fluid from said actuating section of the chamber.

15. A pump according to claim 14, with the addition of a curved production tube having a first end connected to said outwardly opening check valve, a curved portion extending past but separated from said inwardly opening check valve and an upwardly extending portion extending generally parallel to said cylindrical member toward the upper end thereof.

16. A pump comprising a cylinder having an inner tube wall; upper and lower closures on said cylinder forming an interior chamber defined by said inner wall in the cylinder and bounded on opposite ends by said upper and lower closure members; a piston in said chamber dividing said chamber into an actuator section and a pumping section; an inwardly opening check valve communicating with said pumping section of the chamber permitting flow of fluid into the chamber while blocking flow of fluid therethrough from the chamber; an outwardly opening check valve communicating with the pumping section of the chamber permitting flow of fluid from the pumping section of the chamber and blocking flow of fluid therethrough into the pumping section of the chamber, said lower closure having a venturi passage formed therein having opposite ends communicating with said inwardly and outwardly opening check valves, said venturi passage being constructed and arranged to draw sediment from the lower portion of said pumping section; mans resiliently urging said piston to a position wherein the volume of the actuating section of the chamber is smaller than the volume of the pumping section of the chamber; means to deliver pressurized fluid into said actuating section of the chamber for urging the piston through the chamber to decrease the volume of the pumping section of the chamber relative to the actuating section of the chamber; and means to exhaust pressurized fluid from said actuating section of the chamber.

17. A pump according to claim 16, with the addition of a strainer associated with said inwardly opening check valve.

18. Apparatus to remove a first liquid floating on the surface of a second liquid in a well comprising: a vessel having negative buoyancy and having a low liquid level, a high liquid level and an inlet; support means positioning said inlet into the vessel at a location below the surface of the first liquid floating on the surface of the second liquid and above the interface between the upper surface of the second liquid and the lower surface of the first liquid; pump means having an inlet; said pump means comprising a cylinder having an inner tube wall; upper and lower closures on said cylinder forming an interior chamber defined by said inner wall in the cylinder and bounded on opposite ends by said upper and lower closure members; a piston in said chamber dividing said chamber into an actuator section and a pumping section; a cylindrical spring guide sleeve secured to said piston in said pumping section of the chamber to limit movement of said piston to control the minimum volume of said pumping section of the chamber; an inwardly opening check valve communicating with said pumping section of the chamber permitting flow of fluid into the chamber while blocking flow of fluid therethrough from the chamber; an outwardly opening check valve communicating with the pumping section of the chamber permitting flow of fluid from the pumping section of the chamber and blocking flow of fluid therethrough into the pumping section of the chamber; means resiliently urging said piston to a position wherein the volume of the actuating section of the chamber is smaller than the volume of the pumping section of the chamber; means to deliver pressurized fluid into said actuating section of the chamber for urging the piston through the chamber to decrease the volume of the pumping section of the chamber relative to the actuating section of the chamber; means to exhaust pressurized fluid from said actuating section of the chamber; means positioning the inlet to said pump means in the vessel below the low liquid level; means energizing said pump means to remove liquid from said vessel when liquid reaches the high liquid level; and means de-energizing said pump means when the surface of the liquid reaches the low liquid level.

19. Apparatus according to claim 18, said spring guide sleeve comprising: a cylindrical member secured to said piston having an aperture formed in the wall thereof.

20. Apparatus to remove a first liquid floating on the surface of a second liquid in a well comprising: a vessel having negative buoyancy and having a low liquid level, a high liquid level and an inlet; support means positioning said inlet into the vessel at a location below the surface of the first liquid floating on the surface of the second liquid and above the interface between the upper surface of the second liquid and the lower surface of the first liquid; a cylinder having an inner tube wall in said vessel; upper and lower closures on said cylinder forming an interior chamber defined by said inner wall in the cylinder and bounded on opposite ends by said upper and lower closure members; a piston in said chamber dividing said chamber into an actuator section and a pumping section, said piston having a port extending therethrough having a first end communicating with said pumping section of said chamber and a second end communicating with said actuating section of said chamber; a valve seat intermediate opposite ends of said port; valve means in said port; resilient means in said port urging said valve means into engagement with said valve seat for blocking flow of fluid through said port; an inwardly opening check valve communicating with said pumping section of the chamber permitting flow of fluid into the chamber while blocking flow of fluid therethrough from the chamber; an outwardly opening check valve communicating with the pumping section of the chamber permitting flow of fluid from the pumping section of the chamber and blocking flow of fluid therethrough into the pumping section of the chamber; means resiliently urging said piston to a position wherein the volume of the actuating section of the chamber is smaller than the volume of the pumping section of the chamber; means to deliver pressurized fluid into said actuating section of the chamber for urging the piston through the chamber to decrease the volume of the pumping section of the chamber relative to the actuating section of the chamber; means to exhaust pressurized fluid from said actuating section of the chamber; pump means having an inlet; means positioning said inwardly opening check valve below the low liquid level; means energizing said means to deliver pressurized fluid into said actuating section of the chamber to remove liquid from said vessel when liquid reaches the high liquid level; and means de-energizing said means to deliver pressurized fluid into said actuating section of the chamber when the surface of the liquid reaches the low liquid level.

21. Apparatus according to claim 20, said resilient means urging said valve toward a normally closed position blocking the flow of pressurized fluid from the actuating section of the chamber into said pumping section of the chamber until pressure in said actuating section exceeds a predetermined limit whereupon said valve moves away from said valve seat permitting flow of pressurized fluid from said actuating section into said pumping section.

22. Apparatus for removing hydrocarbons from a water table comprising: a vessel having a negative buoyancy, said vessel having an inlet; support means positioning said inlet at a location below the surface of hydrocarbons floating on the surface of the water and above the interface between the upper surface of the water and the lower surface of the hydrocarbon material; pump means having an inlet communicating with said vessel; support means suspending said vessel such that the inlet is positioned above the interface between the water and the hydrocarbons such that hydrocarbons floating on the surface of the water flow into the vessel; and actuating means adapted to energize said pump means when said vessel contains more than a predetermined volume of hydrocarbons, said pump means comprising: a cylinder having an inner tube wall; upper and lower closures on said cylinder forming an interior chamber defined by said inner wall in the cylinder and bounded on opposite ends by said upper and lower closure members; a piston in said chamber dividing said chamber into an upper actuator section and a lower pumping section; a priming tube in said pumping section of said chamber, said priming tube having a central passage formed therethrough, one end of which communicates with an outlet opening from said pumping section and the other end of which is positioned intermediate opposite ends of said pumping section such that downward movement of said piston to reduce the volume of said pumping section causes air above liquid in said pumping section to be delivered into said tube at a location spaced from said lower closure member; means to deliver pressurized fluid into said actuating section of the chamber for urging the piston downwardly through the chamber to decrease the volume of the pumping section of the chamber relative to the actuating section of the chamber; and means to exhaust pressurized fluid from said actuating section of the chamber.

23. Apparatus for removing hydrocarbons from a volume of water according to claim 22, said means to deliver pressurized fluid into said actuating section comprising a source of compressed air; control valve means; a source of pressurized fluid mounted to deliver pressurized fluid to said control valve means; a supply line extending from said control valve means to said actuating section of the chamber.

24. Apparatus for removing hydrocarbons from a volume of water according to claim 23, said means to exhaust pressurized fluid from said actuating section of the chamber comprising: an exhaust line extending from said actuating chamber to said control valve means.

25. Apparatus for removing hydrocarbons from a volume of water according to claim 23, with the addition of: actuating means associated with said support means and said control valve adapted to actuate said control valve when tension in said support means exceeds a predetermined value.

26. Apparatus for removing hydrocarbons from the surface of a volume of water according to claim 23, said means to deliver pressurized fluid into said actuating chamber and said means to exhaust pressurized fluid from said actuating chamber being constructed and arranged to urge said piston downwardly through said interior chamber.

27. Apparatus for removing hydrocarbons from the surface of a volume of water according to claim 23, said vessel comprising: an elongated tubular member having an inner wall; closure means on said tubular member forming an interior compartment formed by said inner wall of the tubular member and bounded on one end by said closure member, upper ends of said tubular member forming a weir over which hydrocarbons flow into said interior compartment.

28. A method of removing hydrocarbons from a water table comprising the steps of: drilling a well to a depth below the surface of an undeground water table; positioning a vessel having negative buoyancy in fluid in the well; positioning an inlet into the vessel at a location below the surface of hydrocarbons floating on the surface of the water table and above the interface between the upper surface of water and the lower surface of the hydrocarbon material; establishing a low liquid level in the vessel; establishing a high liquid level in the vessel; positioning the inlet to a pump in the vessel below the low liquid level; energizing the pump to remove liquid form the vessel when fluid reaches the high liquid level; and de-energizing the pump when the surface of the liquid reaches the low liquid level but above the pump inlet.

29. A method according to claim 28 with the addition of the steps of: inspecting liquid removed from the vessel to determine whether or not the liquid contains water; and moving the inlet of the vessel upwardly in the well if liquid removed from the well contains waters.

30. The method of claim 28 with the addition of the step of determining the buoyancy of the vessel when filled to the high liquid level and when filled to the low liquid level; and energizing and de-energizing the pump when the buoyancy of the vessel reaches the predetermined limits.

31. The method of claim 28 with the addition of the step of determining the water content of liquid removed from the well periodically; and adjusting the height of the inlet into the vessel if it is determined that the water content of the liquid has changed.

32. The method of claim 28 with the addition of the step of positioning a pump in the vessel and suspending the pump from the vessel.

33. The method of claim 28 with the addition of the step of positioning a pump in the vessel and suspending the vessel from the pump.

34. The method of claim 28 with the addition of the step of energizing the pump when the buoyancy of the vessel changes in a range between four and seven pounds.

35. The method of claim 28 wherein the step of positioning the vessel in the well comprises the steps of suspending the vessel from a support cable; suspending the support cable form a force sensing device; and energizing the pump when force applied to the force sensing device reaches a predetermined level.

36. The method of claim 35 with the addition of the step of resiliently biasing an actuating member to a position to de-energize the pump when the surface of liquid in the vessel reaches the predetermined low liquid level and is moved to position to energize the pump when liquid in the vessel rises to the high liquid level.

37. The method of claim 28 with the addition of the step of providing a pneumatically actuated pump adapted to remove a volume of liquid from the vessel approximately equal to the volume of compressed air delivered to the pump.

38. A method according to claim 28 with the addition of the step of forming a sump in the ground adjacent the top of the well; positioning a surface control device in the sump; suspending the vessel from a cable secured to the surface control device; and actuating the surface control device when liquid in the vessel reaches the high liquid level; and de-energizing the surface control device when sufficient liquid has been removed from the vessel to cause the surface of the liquid to reach the low liquid level.

* * * * *

UNITED STATES PATENT AND TRADEMARK OFFICE

CERTIFICATE OF CORRECTION

PATENT NO. :5,013,218

DATED : May 7, 1991

INVENTOR(S) : Larry K. Spencer

It is certified that error appears in the above-identified patent and that said Letters Patent is hereby corrected as shown below:

Column 9, line 16, delete "are", and after "cylinder" and before "bounded" insert -- and --

Signed and Sealed this

Twenty-second Day of September, 1992

*Attest:*

DOUGLAS B. COMER

*Attesting Officer*

*Acting Commissioner of Patents and Trademarks*